United States Patent [19]

Szafarz

[11] Patent Number: 4,761,901

[45] Date of Patent: Aug. 9, 1988

[54] SAFETY GUARD FOR A POWER TOOL DISCHARGE CHUTE

[76] Inventor: Henry Szafarz, 294 Mystic St., Arlington, Mass. 02174

[21] Appl. No.: 922,056

[22] Filed: Oct. 22, 1986

[51] Int. Cl.[4] ..... E01H 5/09

[52] U.S. Cl. ..... 37/262; 56/17.4; 15/317; 15/378; 193/DIG. 2

[58] Field of Search ..... 37/244, 260, 262; 193/4, 6, 22, DIG. 2; 232/54; 56/17.4, DIG. 20, DIG. 24; 15/317, 378, 422

[56] References Cited

U.S. PATENT DOCUMENTS

| | | | |
|---|---|---|---|
| Re. 26,010 | 5/1966 | Rubin . | |
| 2,485,729 | 10/1949 | Gentry . | |
| 2,719,319 | 10/1955 | Brace | 15/378 |
| 2,735,199 | 2/1956 | Wanner . | |
| 3,035,359 | 5/1962 | Ewert . | |
| 3,057,140 | 9/1962 | Ridemour . | |
| 3,080,508 | 3/1963 | Hipple . | |
| 3,111,800 | 11/1963 | Quianthy . | |
| 3,481,124 | 12/1969 | Machovina | 56/17.4 |
| 3,497,263 | 2/1970 | Heth et al. | 37/260 |
| 3,780,455 | 12/1973 | Stevenson et al. . | |
| 3,828,450 | 8/1974 | Boeck | 37/260 |
| 3,903,679 | 9/1975 | Sorenson et al. . | |
| 3,913,247 | 10/1975 | Ruhl . | |
| 3,921,315 | 11/1975 | Tome | 37/260 X |
| 4,138,829 | 2/1979 | Chase . | |
| 4,138,830 | 2/1979 | Chase . | |
| 4,190,973 | 3/1980 | Schmidt . | |
| 4,255,879 | 3/1981 | Greider . | |
| 4,295,285 | 10/1981 | Stevens . | |

*Primary Examiner*—E. H. Eickholt

*Attorney, Agent, or Firm*—Joseph S. Iandiorio; William E. Noonan; Douglas E. Denninger

[57] ABSTRACT

A safety guard device for a power tool discharge chute which includes a shaft attached to the chute and extending across the opening of the chute. There are a plurality of elongate spaced-apart blade elements mounted to the shaft for pivoting within the chute and one or more springs or other resilient elements are provided for biasing the blade elements into a closed condition within the chute to prevent operator access through the opening of the chute and permitting the blades to pivot into an open condition so that bulky material may be discharged through the chute.

23 Claims, 4 Drawing Sheets

SAFETY GUARD FOR A POWER TOOL DISCHARGE CHUTE

FIELD OF INVENTION

This invention relates to an improved safety guard device for the discharge chute of a power tool such as a snow thrower and which, more particularly, prevents introduction of the operator's hands into the discharge chute to an unsafe level.

BACKGROUND OF INVENTION

Conventional snow throwers typically employ a large main blade for gathering and breaking up the ice and snow and one or more smaller impeller blades which collect the snow and discharge it from the machine through a discharge chute. If the chute clogs with ice and snow as it often does when wet snow, slush and/or freezing weather prevail, it becomes necessary to clean out and around the chute to permit proper snow throwing action to resume. However, this is an extremely hazardous maneuver because the impeller blades are whirling at an extremely high speed, typically less than an inch below the bottom of the chute opening and are invisible to the eye. It often becomes virtually impossible to determine the precise location of the whirling blades inside the housing rim during snow removal operations. Even the most careful operators have made misjudgments with unfortunate results. If the operator accidentally inserts a hand or fingers into this area of the chute, he risks being caught in a scissor-like manner between the blades of the powerful impeller and its housing. Even the slightest penetration of the operator's hands or fingers in the vicinity of the spinning impeller blades is liable to cause serious injury or maiming.

In an attempt to improve the safety of the discharge chute, one device, U.S. Pat. No. 3,921,315, employs a spring loaded "M" shaped element pivotally mounted in the chute and extending partially across the discharge opening thereof. However, this apparatus is largely ineffective in a number of snow throwers. The "M" shaped wire guard includes a number of relatively large gaps through which the operator's hands and fingers may be accidentally inserted. Moreover, the device provides virtually no protection across the critical bottom of the discharge opening. While brushing out ice and snow from the bottom of the chute the unsuspecting operator can easily slip a hand or finger beneath the wire "M" and dangerously close to the whirling impeller blades. Additionally, in many machines the spring is entirely omitted which permits the "M" element to flop uselessly out of the chute. As a result, the safety device provides absolutely no impedance to the introduction of the operator's hands or fingers. A further difficulty is the relatively smooth flowing lines of the wire "M" element which do not effectively warn the operator against, or inhibit him from, putting his hands or fingers too far into the discharge chute.

SUMMARY OF INVENTION

It is therefore an object of this invention to provide an improved safety guard device for the discharge chute of a power tool which effectively hinders excessive inadvertent introduction of the operator's hands or fingers into the discharge chute.

It is a further object of this invention to provide a safety guard device for the discharge chute of a power tool which guards against accidental introduction of the operator's hands or fingers proximate the bottom of the discharge chute opening where he can be severely injured or maimed by the high-speed impeller blades.

It is a further object of this invention to provide a safety guard device for the discharge chute of a power tool which includes sharply pointed contours to repulse the operator and effectively and timely alert him that he is dangerously close to the high speed blades.

It is a further object of this invention to provide a safety guard device which is particularly effective for use in the discharge chutes of snow throwers and which permits effective discharge of both finely broken snow and ice and larger chunks and debris such as limbs and rocks.

It is a further object of this invention to provide a safety guard device which may be readily, conveniently and inexpensively installed in a wide variety of power tool discharge chutes.

This invention results from the realization that an improved safety guard for the discharge chutes of power tools such as snow throwers may be achieved by employing a shaft mounted proximate the base and across the entrance of the discharge chute opening to hinder accidental introduction of hands or fingers into the chute in the vicinity of the impeller blades. This invention also results from the realization that such safety is further enhanced by attaching to the shaft a plurality of elongate blade elements having pointed tips.

This invention features a safety guard device for a power tool discharge chute including shaft means attached to the chute and extending across the opening of the chute. There are a plurality of elongate spaced-apart blade elements mounted to the shaft means for pivoting within the chute and resilient means are provided for biasing the blade elements into a closed condition within the chute to prevent operator access through the opening of the chute. The resilient means also permits the blades to pivot into an open condition so bulky material may be discharged through the chute.

In a preferred embodiment this device is employed with a discharge chute which is mounted on a base and the power tool includes at least one rotatable impeller blade mounted proximate the base. In such embodiments it is preferred that the shaft means be attached to the chute closely proximate the base to prevent introduction of hands and fingers between the shaft means and the base. The shaft means may be attached to the chute to extend generally across the entrance to the opening of the chute, which may be, for example, an entrance which extends generally from the base. The shaft means may be spaced no greater than approximately one-half inch above the base.

Means may be provided for pivotably mounting the shaft to the chute and means may also be included for fixably securing the blade elements to the pivotably mounted shaft means. The means for fixably securing may include bushing elements, each interconnecting a respective blade element to the shaft means. The resilient means may be interconnected between, on the one hand, one of the chute and the means for pivotably mounting and, on the other hand, the shaft means. Alternatively, means may be provided for pivotably mounting the blade elements on the shaft means and the shaft means may be fixably mounted to the discharge chute. In such cases, the resilient means may include a plurality of resilient elements each being interconnected between the shaft means and a respective blade element. Typically the resilient means include one or more springs disposed about the shaft means.

Each blade element may be pointed at its distal end to alert the operator against excessive introduction of his hands and fingers into the discharge chute. The distal ends of the blade elements may engage the inside surface of the chute in the closed condition. Typically at least three blade elements are mounted to the shaft means and the blade elements are thin relative to the spacing therebetween for permitting unhindered discharge of fine material through the blades in the closed condition. The blade elements are preferably spaced approximately one to two inches apart. They may extend in a substantially parallel arrangement and may extend substantially perpendicular from the shaft means.

The safety guard device of this invention is particularly preferred for use in a snow thrower.

DISCLOSURE OF PREFERRED EMBODIMENT

Other objects, features and advantages will occur from the following description of a preferred embodiment and the accompanying drawings, in which.

Figure 1:
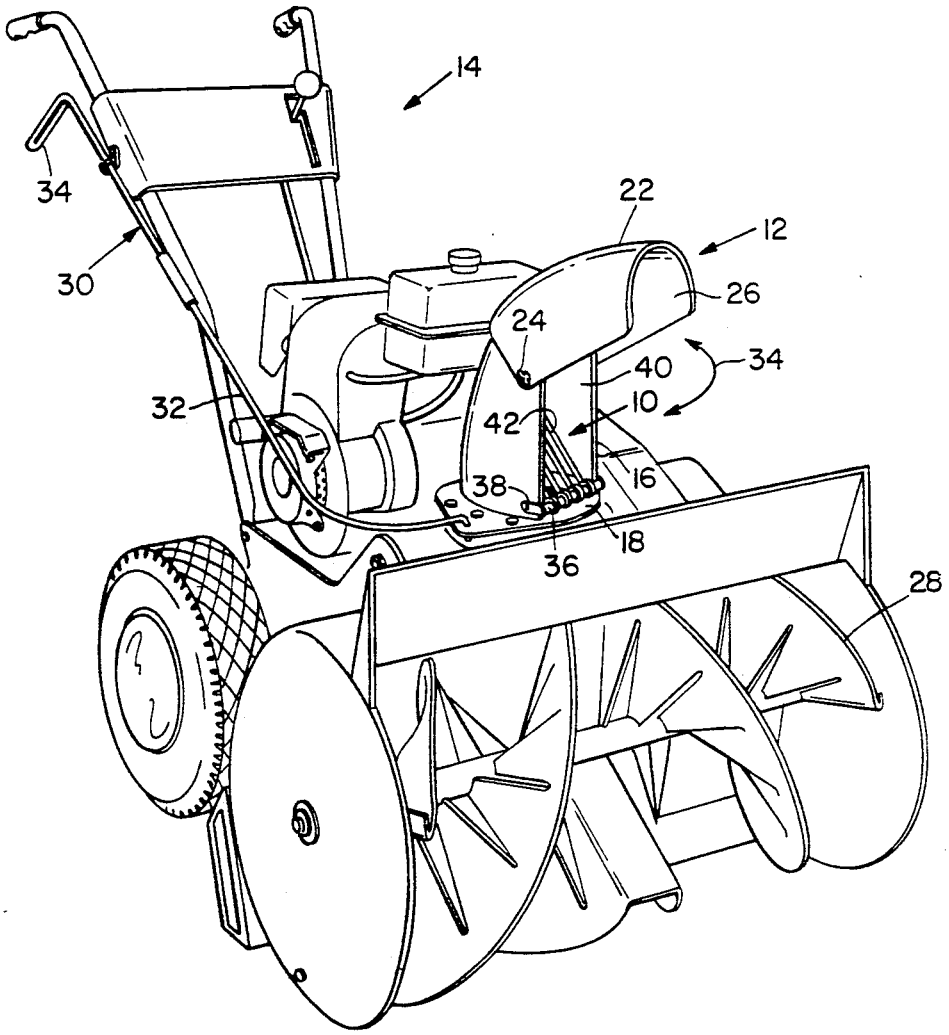
FIG. 1 is an axonometric view of a snow thrower employing the safety guard device of this invention.

An improved safety guide device for the discharge chute of a power tool such as a snow thrower may be accomplished according to this invention by providing a shaft which is attached to and extends across the opening of the discharge chute. The shaft is typically constructed of metal, durable plastic, or other rugged material. In a typical snow thrower, where the discharge chute is mounted on a base and one or more impeller blades are disposed proximate the base, e.g., typically less than one inch below the base, the shaft is attached to the chute closely proximate the base, e.g., one-half inch or closer. As a result, the gap between the shaft and the base is so small that it is virtually impossible for the operator to introduce his hands or fingers accidentally between the shaft and the base while cleaning ice and snow from the base and chute.

Multiple, and typically at least three, elongate spaced-apart blade elements are mounted to the shaft for pivoting within the chute. These blade elements extend perpendicularly from the shaft and are arranged parallel to one another. Each blade is secured to the shaft by a respective bushing element or similar means. The blade elements are preferably composed of thin strips of aluminum, steel or other metals. Other alternative strong durable materials may also be utilized. In a preferred arrangement the shaft is pivotably mounted in the chute and the blade elements are fixably secured to the shaft. However, the shaft may be fixed to the chute and the blade elements pivotably mounted on the shaft.

Resilient means such as one or more springs are provided for biasing the blade elements into a closed condition within the chute to prevent operator access through the opening of the chute. In such a closed condition the blade elements typically engage the inside surface of the chute. Where the shaft is pivotably mounted in the chute, a single spring is preferably interconnected between the chute and the shaft. Where, however, the blade elements are pivotably mounted on the shaft, a respective spring is interconnected between the shaft and each blade element.

The distal end of each blade element preferably includes a sharp point so that if the operator accidentally attempts to introduce his hand too far into the chute the sharp tips of the blade elements warn him before his hand encounters the whirling high-speed impeller blades. The blade elements of the safety guard are thin relative to the spacing between them so that, in the closed condition, fine material such as finely broken snow and ice may be discharged without hindrance through the blades. For example, a typical blade thickness is 1/16 inch with a preferred blade spacing of one to two inches.

The spring or springs permit the blades to be pivoted into an open condition so that bulky chunks of snow and ice or other bulky material such as rocks or tree limbs may be discharged through the chute. In a typical snow thrower the discharge chute includes an opening which extends generally from the base. It is preferred that the shaft be mounted to extend across the entrance to the chute opening. This further prevents the operator's hands from being introduced too far into the discharge chute or between the shaft and the base where the dangerous spinning impeller is disposed.

There is shown in FIG. 1 a safety guard 10 according to this invention mounted in the discharge chute 12 of a snow thrower 14. Discharge chute 12 includes a lower portion 16 supported on a base 18 that is rotatably mounted in a conventional manner to the snow thrower. An upper chute portion 22 is attached to lower portion 16 by bolts 24, only one of which is shown in FIG. 1. Together portions 16 and 22 define a discharge opening 26 through which ice, snow and other material is discharged. More particularly, as snow thrower 14 is operated, its large helical blade 28 breaks up the snow and ice. The broken-up material is collected by an impeller device, mounted just below base 18 and described more fully in connection with FIGS. 2 and 3, which discharges it through opening 26. A directional mechanism 30 includes a cable 32 attached to base 18. By longitudinally adjusting cable 32 the operator is able to rotate discharge device 12 approximately 180° in the direction of doubleheaded arrow 34 so that snow may be discharged in a desired direction.

Safety guard 10 includes a shaft 36 which is pivotably mounted by a pair of mounting brackets 38 and 39, the latter of which is not shown in FIG. 1, to the opposite sides of the lower portion 16 of discharge chute 12 proximate base 18. Mounting brackets 38, 39 extend forwardly of the entrance 40 of discharge opening 26 so that shaft 36 extends across entrance 40. A plurality of blade elements 42 are mounted to shaft 36 for pivoting within discharge chute 12. In the closed condition shown in FIG. 1 blade elements 42 extend into the discharge chute opening 26 and finely broken snow and ice is passed between the blade elements as it is discharged through the chute.

Figure 2:
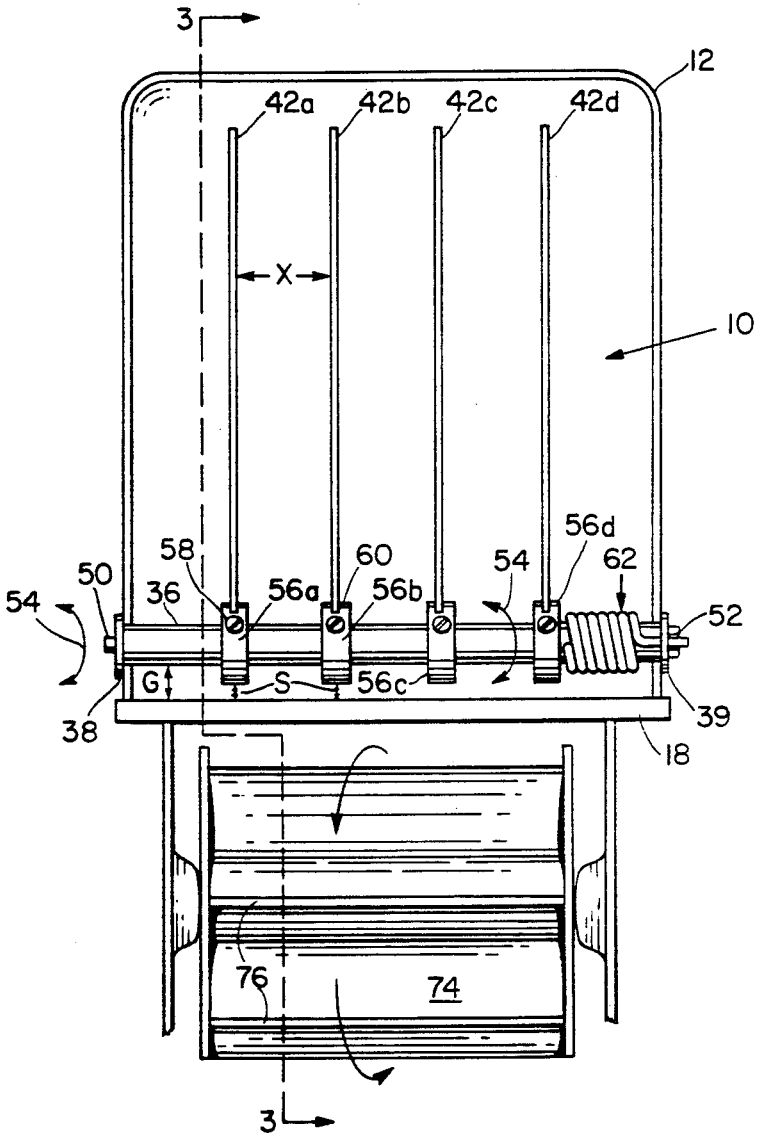
FIG. 2 is a front elevational view of the safety guard device mounted in a discharge chute.
Figure 3:
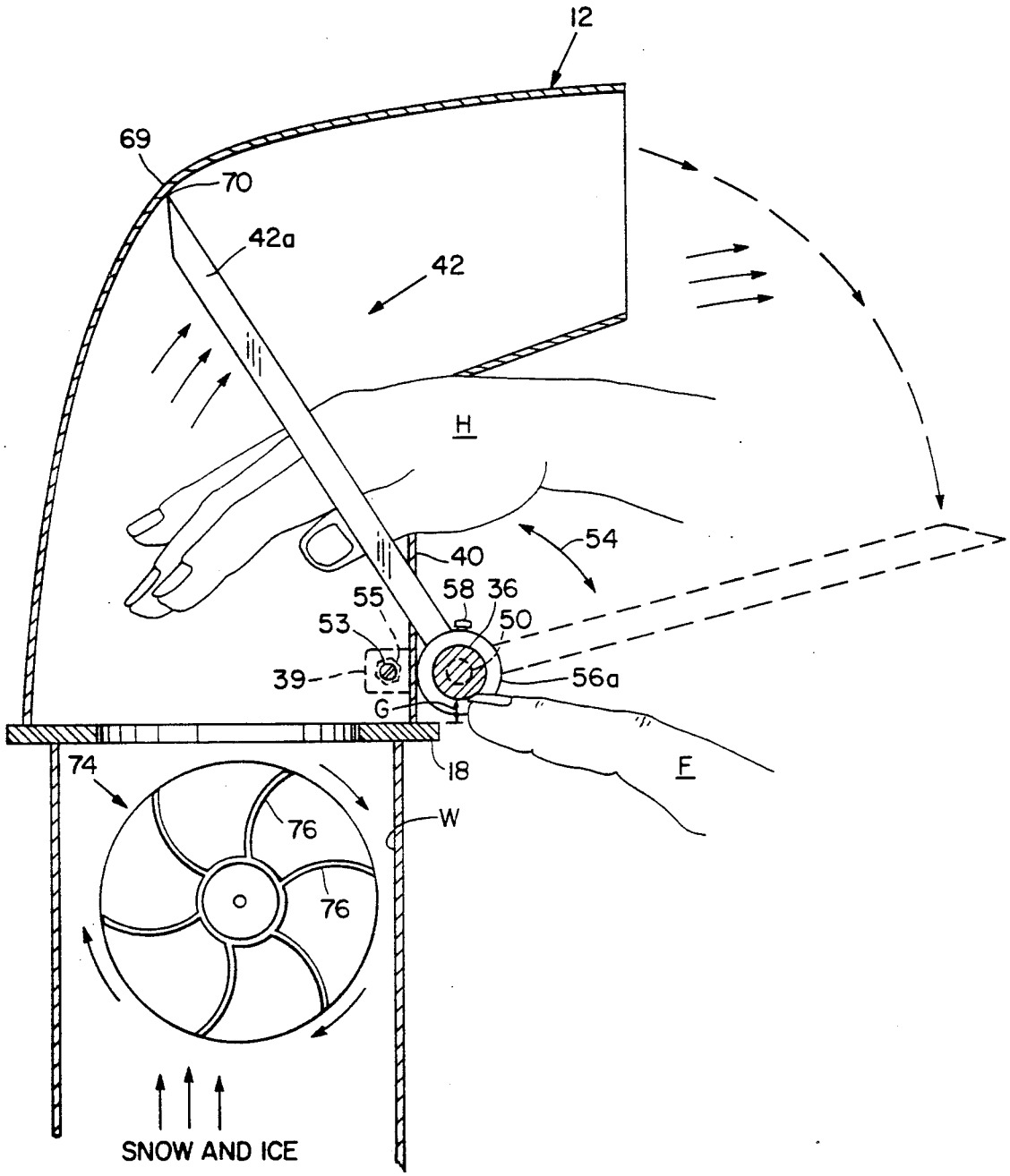
FIG. 3 is a cross sectional view taken along line 3—3 of FIG. 2.

As shown in FIG. 2, shaft 36 has reduced diameter end portions 50 and 52 which extend through complementary holes in respective mounting brackets 38, 39. This enables shaft 36 to rotate in the direction of doubleheaded arrows 54. Each mounting bracket, for example, bracket 38, FIG. 3, is attached to discharge chute 12 by an appropriate bolt 53 extending through the bracket and chute 12 and a nut 55 secured to the bolt. In alternative embodiments the shaft may be mounted directly through chute 12 and employ suitable mounting bushings rather than the mounting bracket disclosed in FIGS. 1–3.

Individual blade elements 42*a*, 42*b*, 42*c* and 42*d* are attached to shaft 36 by respective bushing elements 56*a*–56*d*. Each bushing element is mounted on shaft 36 and is fixably secured thereto by set screw 58. Each bushing also includes a slot 60 which receives one end of a respective blade 42*a*–42*d*. The blades extend perpendicularly from shaft 36 in a parallel arrangement. The distal end of each blade is formed, by machining or otherwise, into a sharp point 70, FIG. 3. To remove and/or replace bushings 56*a*–56*d* or blades 42*a*–42*d* the mounting brackets 38, 39 are detached from chute 12. To remove a respective bushing 56*a*–56*d* its bushing screw 58 is loosened and the bushing is simply slid off shaft 36. To replace a broken or worn blade, the old blade is removed from bushing slot 60 and a new blade is inserted.

Blades 42*a*–42*d* are biased into a closed condition within chute 12 by a spring 62, FIG. 2, which is connected at one end to mounting bracket 39 and at the other end to shaft 36. As shown most clearly in FIG. 3, with the blade elements 42 in the closed condition the distal end of each blade, e.g., blade 42*b*, engages the inside surface of chute 12 at location 69. In this closed condition broken-up snow and ice is discharged between the blades and out of chute 12. This material is collected and delivered to chute 12 by a high speed impeller device 74 which has a plurality of blades 76 and is mounted in a conventional manner proximately below base 18. Pivotable blades 42*a*–42*d* of guard 30 are relatively thin, e.g., 1/16 of an inch, compared to the spacing between them, e.g., 1½ inches, so that the finely broken-up snow and ice is discharged unhindered between the blades and out of the chute. However, at times the snow thrower may encounter and pick up larger chunks of snow and ice and other bulky material such as rocks or tree limbs which cannot be broken up. This material is collected by blade 76 of impeller 74 and directed into chute 12. Blades 42 are engaged by the bulky material and pivoted on shaft 36 to the open position shown in phantom in FIG. 3. In this manner, material which is unable to fit between the spaced-apart blades 42 is discharged from chute 12. As soon as the bulky material has been ejected from the chute, spring 62 urges shaft 36 and attached blades 42 to resume the closed condition within the chute.

As illustrated in FIGS. 2 and 3, the spinning blades 76 are typically within an inch of the base. A number of features of safety guard 10 prevent the operator from inadvertently introducing his hands or fingers below base 18 in the vicinity of impeller blades 76 and protect these members from being caught between the high-speed blades and the wall W, FIG. 3, of the snow thrower. Certain of these features are designed specifically to prevent fingers from being inserted between shaft 36 and base 18. For example, a preferred shaft 36, approximately ¾ inch in diameter, is attached to the chute closely proximate base 18 so that a vertical gap G, FIGS. 2, 3, of only ½ inch or less is provided between the shaft and the base. As a result, it is virtually impossible for the operator's finger F, FIG. 3, to fit between shaft 36 and base 18 and the risk that the operator will be cut or maimed by impeller blades 76 is significantly reduced. The vertical gap above base 18 is reduced even more by bushing elements 56*a*–*d* which typically include a diameter of 1¼ inches and, as a result, provide an even smaller space S, FIG. 2, of only approximately ¼ inch between the bushings and base 18. At the same time, horizontal gaps between shaft 36 and base 18 are eliminated because shaft 36 is mounted to extend in front of entrance 40 of chute opening 26.

As shown most clearly in FIG. 3, when blade elements 42 are closed they prevent dangerously excessive introduction of the operator's hand H into the opening of chute 12 above shaft 36. The pointed distal end of each blade engages the inside surface of chute 12 and forms a baffle through which hand H cannot easily pass. Preferably the blades are spaced apart by a distance X, FIG. 2, of approximately 1½ inches which is close enough to prevent introduction of most hands. Because shaft 36 extends across entrance 40 of chute 12 and because the attached blade elements 42 extending therefrom pivot closed only until they engage the inside surface of chute 12 at location 69, the closed blade elements 42 are positioned sufficiently upright within the opening of chute 12 that even if the fingers of operator's hand H, FIG. 3, are inadvertently inserted between the spaced-apart blades 42 they remain safely removed from the spinning impeller blades 76.

If, while cleaning the discharge chute to remove freezing snow, slush or ice buildup, with the safety guard open or partially opened, the operator introduces his hand or fingers into the upper portion of the discharge chute opening, he encounters pointed ends 70 of blades 42. The sharp points 70 remind the operator that he has introduced his hand too far into the discharge chute and further help to prevent a catastrophic accident.

Figure 4:
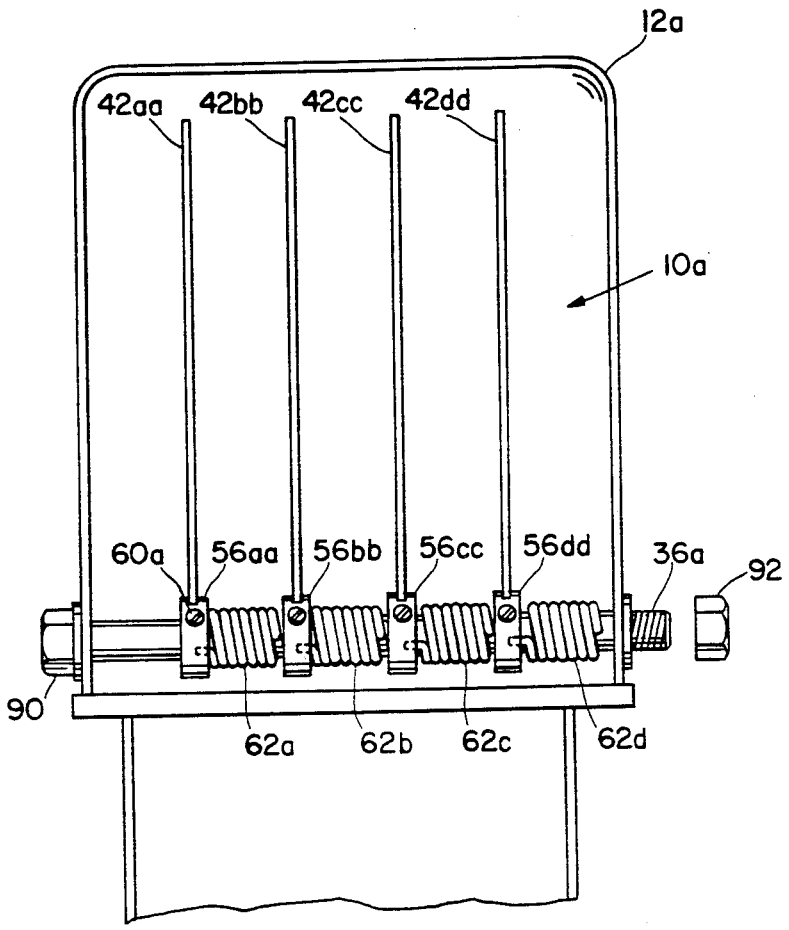
FIG. 4 is a front elevational view of an alternative safety guard device installed in a discharge chute.

In an alternative embodiment, FIG. 4, shaft 36*a* extends across the opening of discharge chute 12*a* and is fixably secured at each end by nuts 90 and 92 attached to the threaded ends of the shaft. Thin elongate blade elements 42*aa*, 42*bb*, 42*cc* and 42*dd* are pivotably mounted by respective bushings 56*aa*, 56*bb*, 56*cc* and 56*dd* to shaft 36*a*. Each bushing 56*aa*–56*dd* again includes a slot 60*a* for receiving one end of a respective blade element 42*aa*–42*dd*. Each blade is biased into a closed condition within chute 12*a* by a respective coil spring 62*a*–62*d* which is attached at one end to fixed shaft 36*a* and at its other end to the bushing 56*aa*–56*dd* holding that blade element. As in the previous embodiment, blade elements 42*aa*–42*dd* are biased into the closed condition to permit passage of finely broken snow and ice. When the snow thrower encounters larger chunks and debris that cannot be passed through the spaces between the blades, the blades 42*aa*–42*dd* pivot individually into an open condition to permit passage of the bulky material.

The dimensions of safety guard 10*a* are approximately the same as those of safety guard 10 and the device of FIG. 4 prevents excessive introduction of the operator's hands and fingers into the discharge chute proximate the dangerous impeller blades in a manner similar to that shown in the previous embodiment.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A safety guard device for a power tool discharge chute, comprising:

shaft means attached to the chute and extending across the opening of the chute;

a plurality of elongate spaced apart blade elements mounted to said shaft means for pivoting within said chute; and resilient means for biasing said blade elements into a closed condition within the chute to prevent operator access through the opening of the chute and permitting said blades to pivot into an open condition so that bulky material may be discharged through the chute.

2. The device of claim 1 in which the discharge chute is mounted on a base and the power tool includes at least one rotatable impeller blade disposed proximate said base and in which said shaft means is attached to said chute closely proximate the base to prevent introduction of hands and fingers between said shaft means and said base.

3. The device of claim 2 in which the opening of the chute includes an entrance which extends generally from said base and in which said shaft means extends across said entrance to the chute opening.

4. The device of claim 1 in which said shaft means is attached to the chute to extend generally across the entrance to the opening of the chute.

5. The device of claim 1 further including means for pivotably mounting said shaft means to the chute.

6. The device of claim 5 further including means for fixably securing said blade elements to said shaft means.

7. The device of claim 6 in which said means for fixably securing includes bushing elements, each interconnecting a respective blade element to said shaft means.

8. The device of claim 5 in which said resilient means is interconnected between, on the one hand, one of the chute and said means for pivotably mounting and, on the other hand, said shaft means.

9. The device of claim 1 further including means for pivotably mounting said blade elements on said shaft means.

10. The device of claim 9 in which said shaft means is fixably mounted to the chute.

11. The device of claim 10 in which said resilient means includes a plurality of resilient elements, each being interconnected between said shaft means and a respective said blade element, for enabling said blade elements to be independently pivotable.

12. The device of claim 8 in which said resilient means includes a spring disposed about said shaft means.

13. The device of claim 1 in which each said blade element is pointed at its distal end to alert the operator against excessive introduction of his hands and fingers into the discharge chute.

14. The device of claim 1 in which the distal ends of said blade elements engage the inside surface of the chute in the closed condition.

15. The device of claim 1 including at least three said blade elements mounted to said shaft means.

16. The device of claim 1 in which said blade elements are thin relative to the spacing therebetween for permitting unhindered discharge of fine material through the blades in the closed condition.

17. The device of claim 1 in which said blade elements are spaced approximately one to two inches apart.

18. The device of claim 2 in which said shaft means is spaced no greater than approximately one-half inch above the base.

19. The device of claim 1 in which said blade elements extend in a substantially parallel arrangement from said shaft means.

20. The device of claim 1 in which said blade elements extend substantially perpendicular from said shaft means.

21. A safety guard device for a snow thrower discharge chute comprising:

shaft means attached to the chute and extending across the opening of the chute;

a plurality of elongate spaced apart blade elements mounted to said shaft means for pivoting within said chute; and resilient means for biasing said blade elements into a closed condition within the chute to hinder operator access through the opening of the chute and permitting said blades to pivot into an open condition so that bulky material may be discharged through the chute.

22. The device of claim 21 in which the discharge chute is mounted on a base and the snow thrower includes at least one rotatable impeller blade disposed proximate the base and in which said shaft means is attached to said chute closely proximate said base to prevent introduction of hands and fingers between said shaft means and said base.

23. A safety guard device for a power tool discharge chute, comprising:

shaft means attached to the chute and extending across the opening of the chute;

a plurality of elongate spaced apart guard elements mounted to said shaft means for pivoting within said chute, said guard elements being thin relative to the spacing therebetween for permitting unhindered discharge of fine material through the guard element in the closed condition;

resilient means for strongly biasing said guard elements into a closed condition within the chute to prevent operator access through the opening of the chute and permitting said guard elements to pivot into an open condition so that bulky material may be discharged through the chute; and means for pivotably mounting said guard elements on said shaft means, and said resilient means including a plurality of resilient elements, each being interconnected between said shaft means and a respective said guard element, for enabling said guard elements to be independently pivotable.

* * * * *